US008960273B2

(12) United States Patent
Bara et al.

(10) Patent No.: US 8,960,273 B2
(45) Date of Patent: Feb. 24, 2015

(54) ARTIFICIAL LIFT SYSTEM FOR WELL PRODUCTION

(71) Applicant: Omedax Limited, Limassol (CY)

(72) Inventors: Clayton Bara, Leduc (CA); Phil Fouillard, Sherwood Park (CA); Darren Part, St. Albert (CA)

(73) Assignee: Oilfield Equipment Development Center Limited, Victoria (SC)

( * ) Notice: Subject to any disclaimer, the term of this patent is extended or adjusted under 35 U.S.C. 154(b) by 296 days.

(21) Appl. No.: 13/626,729

(22) Filed: Sep. 25, 2012

(65) Prior Publication Data

US 2013/0105156 A1 May 2, 2013

Related U.S. Application Data

(60) Provisional application No. 61/552,219, filed on Oct. 27, 2011.

(51) Int. Cl.

| | |
|---|---|
| ***E21B 43/24*** | (2006.01) |
| ***E21B 43/12*** | (2006.01) |
| ***E21B 17/10*** | (2006.01) |
| ***F04D 13/10*** | (2006.01) |
| ***F04D 29/047*** | (2006.01) |

(52) U.S. Cl.

CPC ..... *E21B 43/126* (2013.01); *E21B 43/2408* (2013.01); *E21B 17/1057* (2013.01); *E21B 17/1071* (2013.01); *F04D 13/10* (2013.01); *F04D 29/0473* (2013.01)

USPC ..... 166/68.5; 166/62; 166/72; 166/105; 166/272.7; 166/303

(58) Field of Classification Search

USPC ..... 166/50, 62, 68.5, 69, 72, 105, 272.3, 166/272.7, 303, 313; 175/325.3, 325.7; 415/104, 107

See application file for complete search history.

(56) References Cited

U.S. PATENT DOCUMENTS

| | | | | |
|---|---|---|---|---|
| 2,171,171 | A * | 8/1939 | Brauer | 166/68 |
| 2,633,392 | A * | 3/1953 | Luenberger | 384/97 |
| 4,071,101 | A * | 1/1978 | Ford | 175/325.3 |
| 4,073,606 | A * | 2/1978 | Eller | 417/423.12 |
| 5,113,937 | A * | 5/1992 | Cholet | 166/105.5 |
| 5,160,240 | A | 11/1992 | Wilson | |
| 5,348,094 | A * | 9/1994 | Cholet et al. | 166/371 |
| 5,573,063 | A | 11/1996 | Morrow | |
| 5,829,529 | A * | 11/1998 | Cholet et al. | 166/369 |
| 6,183,162 | B1 * | 2/2001 | Sheppard et al. | 405/128.25 |

(Continued)

OTHER PUBLICATIONS

Patterson, John C. et al.—Paper entitled "The Geared Centrifugal Pump—Project Update" prepared for presentation at the 2011 Society of Petroleum Engineers, Gulf Coast Section Electric Submersible Pump Workshop, held in The Woodlands, Texas, Apr. 29 to May 1, 2009.

(Continued)

*Primary Examiner* — Kenneth L Thompson

(74) *Attorney, Agent, or Firm* — Patterson & Sheridan, L.L.P.

(57) ABSTRACT

A method of pumping production fluid from a wellbore includes deploying a centrifugal pump into a production wellbore; and pumping hydrocarbons from the production wellbore by rotating an impeller of the centrifugal pump in the production wellbore from surface using a drive string, wherein the impeller is rotated at a speed less than or equal to seventeen hundred fifty revolutions per minute.

25 Claims, 5 Drawing Sheets

(56) References Cited

U.S. PATENT DOCUMENTS

| | | | | |
|---|---|---|---|---|
| 6,209,667 | B1 * | 4/2001 | Murray et al. | 175/325.3 |
| 6,388,353 | B1 | 5/2002 | Liu et al. | |
| 6,471,495 | B1 * | 10/2002 | Allen et al. | 417/423.6 |
| 6,557,639 | B1 * | 5/2003 | Matthews et al. | 166/369 |
| 6,708,759 | B2 | 3/2004 | Leaute et al. | |
| 6,708,763 | B2 | 3/2004 | Howard et al. | |
| 6,769,486 | B2 * | 8/2004 | Lim et al. | 166/263 |
| 7,150,600 | B1 * | 12/2006 | Vennat | 415/199.2 |
| 7,255,165 | B2 | 8/2007 | Abdo et al. | |
| 7,270,178 | B2 * | 9/2007 | Selph | 166/105.5 |
| 7,290,608 | B2 * | 11/2007 | Wittrisch | 166/266 |
| 7,314,089 | B2 * | 1/2008 | Howard et al. | 166/370 |
| 7,793,717 | B2 | 9/2010 | Davison | |
| 7,854,259 | B2 | 12/2010 | Davison | |
| 7,874,369 | B2 | 1/2011 | Parker et al. | |
| 7,896,624 | B2 | 3/2011 | Dass | |
| 8,215,387 | B1 | 7/2012 | Weiers et al. | |
| 8,336,632 | B2 | 12/2012 | Morrow et al. | |
| 2005/0047944 | A1 | 3/2005 | Howard | |
| 2009/0314499 | A1 | 12/2009 | Bussear et al. | |
| 2010/0155076 | A1 | 6/2010 | Scarsdale et al. | |
| 2010/0319904 | A1 | 12/2010 | Morrow | |
| 2011/0052418 | A1 | 3/2011 | Morrow | |
| 2014/0219825 | A1 * | 8/2014 | Santos et al. | 417/53 |
| 2014/0262259 | A1 * | 9/2014 | Fouillard et al. | 166/272.3 |

OTHER PUBLICATIONS

Patterson, John C. et al.—Paper entitled "The Geared Centrifugal Pump—a New High-Volume Lift System" prepared for presentation at the 2011 Society of Petroleum Engineers, Gulf Coast Section Electric Submersible Pump Workshop, held in The Woodlands, Texas, Apr. 25-29, 2011.

* cited by examiner

ARTIFICIAL LIFT SYSTEM FOR WELL PRODUCTION

BACKGROUND OF THE INVENTION

1. Field of the Invention

Embodiments of the present invention generally relate to an artificial lift system for well production.

2. Description of the Related Art

One type of adverse well production is steam assisted gravity drainage (SAGD). SAGD wells are quite challenging to produce. They are known to produce at temperatures above two hundred degrees Celsius. They are typically horizontally inclined in the producing zone. The produced fluids can contain highly viscous bitumen, abrasive sand particles, high temperature water, sour or corrosive gases and steam vapor. Providing oil companies with a high volume, highly reliable form of artificial lift is greatly sought after, as these wells are quite costly to produce due to the steam injection needed to reduce the in-situ bitumen's viscosity to a pumpable level.

For the last decade, the artificial lift systems deployed in SAGD wells have typically been Electrical Submersible Pumping (ESP) systems. Although run lives of ESP systems in these applications are improving they are still well below "normal" run times, and the costs of SAGD ESPs are three to four times that of conventional ESP costs.

SUMMARY OF THE INVENTION

Embodiments of the present invention generally relate to an artificial lift system for well production. In one embodiment, a method of pumping production fluid from a wellbore includes deploying a centrifugal pump into a production wellbore; and pumping hydrocarbons from the production wellbore by rotating an impeller of the centrifugal pump in the production wellbore from surface using a drive string, wherein the impeller is rotated at a speed less than or equal to seventeen hundred fifty revolutions per minute.

In another embodiment, a downhole assembly of an artificial lift system includes: a receptacle for receiving a coupling of a drive string, the receptacle including a housing having a coupling for connection to a production tubing string and a shaft; a centrifugal pump including a housing connected to the receptacle housing and a shaft connected to the receptacle shaft; a thrust chamber including: a housing connected to the pump housing, a shaft torsionally and longitudinally connected to the pump shaft, a thrust bearing having a thrust driver longitudinally and torsionally connected to the pump shaft and a thrust carrier longitudinally and torsionally connected to the chamber housing, wherein: the thrust bearing is operable to receive thrust from the pump shaft, and the thrust bearing is in fluid communication with a pumped fluid path.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
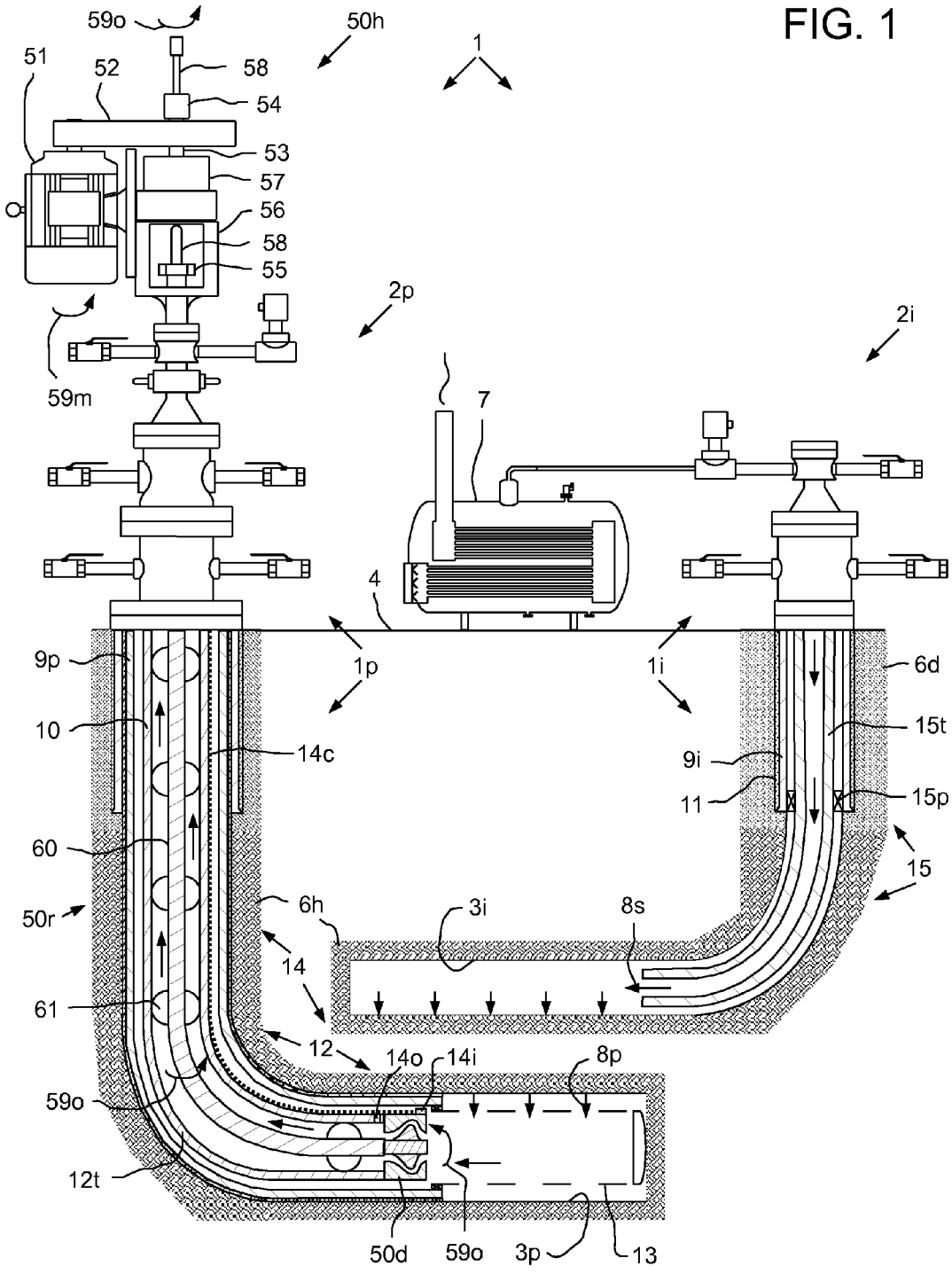
FIG. 1 illustrates an artificial lift system (ALS) pumping production fluid from a steam assisted gravity drainage (SAGD) well, according to one embodiment of the present invention.

FIG. 1 illustrates an artificial lift system (ALS) 50*h, r, d* pumping production fluid, such as bitumen 8*p* (aka tar sand or oil sand), from a steam assisted gravity drainage (SAGD) well 1, according to one embodiment of the present invention. Alternatively, the production fluid may be heavy crude oil or oil shale. The ALS 50*h, r, d* may include a drive head 50*h*, a drive string 50*r*, and a downhole assembly 50*d*. The SAGD well 1 may include an injection well 1*i* and a production well 1*p*. Each well 1*i, p* may include a wellhead 2*i, p* located adjacent to a surface 4 of the earth and a wellbore 3*i, p* extending from the respective wellhead. Each wellbore 3*i, p* may extend from the surface 4 vertically through a non-productive formation 6*d* and horizontally through a hydrocarbon-bearing formation 6*h* (aka reservoir). Alternatively the horizontal portions of either or both wellbores may be other deviations besides horizontal. Alternatively, the injection well may be omitted and the ALS may be used to pump production fluid from other types of adverse production wells, such as high temperature wells.

Surface casings 9*i, p* may extend from respective wellheads 2*i, p* into respective wellbores 3*i, p* and each casing may be sealed therein with cement 11. The production well 1*p* may further include an intermediate casing 10 extending from the production wellhead 2*p* and into the production wellbore 3*p* and sealed therein with cement 11. The injection well 1*i* may further include an injection string 15 having an injection tubing string 15*t* extending from the injection wellhead 2*i* and into the injection wellbore 3*i* and having a packer 15*p* for sealing an annulus thereof.

A steam generator 7 may be connected to the injection wellhead 2*i* and may inject steam 8*s* into the injection wellbore 3*i* via the injection tubing string 15*t*. The injection wellbore 3*i* may deliver the steam 8*s* into the reservoir 6*h* to heat the bitumen 8*p* into a flowing condition as the added heat added reduces viscosity thereof. The horizontal portion of the production wellbore 3*p* may be located below the horizontal portion of the injection wellbore 3*i* to receive the bitumen drainage 8*p* from the reservoir 6*h*.

A production string 12 may extend from the production wellhead 2*p* and into the production wellbore 3*p*. The production string 12 may include a string of production tubing 12*t* and the downhole assembly 50*d* connected to a bottom of the production tubing. A slotted liner 13 may be hung from a bottom of the intermediate casing 10 and extend into an open hole portion of the production wellbore 3*p*. The downhole assembly 50*d* may be located adjacent a bottom of the intermediate casing 10. Alternatively, the downhole assembly 50*d* may be located within the slotted liner 13. An instrument string 14 may extend from the production wellhead 2*p* and into the production wellbore 3*p*. The instrument string 14 may include a cable 14*c* and one or more sensors 14*i, o* in data communication with the cable. The sensors 14*i, o* may include a first 14*i* pressure and/or temperature sensor in fluid communication with the bitumen 8*p* entering the downhole assembly 50*d* and a second 14*o* pressure and/or temperature sensor in fluid communication with the bitumen discharged from the downhole assembly.

The drive head 50*h* may include a motor 51, a transmission 52, an output shaft 53, a clamp 54, a stuffing box 55, a frame 56, a thrust bearing 57, and a drive shaft, such as a polished rod 58. The motor 51 may be electric, such as a two-pole, three-phase, squirrel-cage induction type and may operate at a nominal rotational speed 59*m* of thirty-five hundred revolutions per minute (RPM) at sixty Hertz (Hz). Alternatively, the motor may be hydraulic or pneumatic. A housing of the motor 51 may be connected to the frame 56. The frame 56 may be connected to the wellhead 2*p*. A shaft of the motor 51 may be connected to the transmission 52. The transmission 52 may be a belt and sheave, roller chain and sprockets, or a gearbox. Alternatively, the drive head may be direct drive (no transmission). The output shaft 53 may be connected to the transmission 52. The transmission 52 may rotate the output shaft 53 at a rotational speed 59*o* less than the motor rotational speed 59*m*. The speed ratio (output speed 590*o* divided by motor speed 59*m*) of the transmission 52 may be less than or equal to one-half, nine-twentieths, three-eighths, or one-third such that the output speed 59*o* may be less than or equal to (about) seventeen hundred fifty, sixteen hundred, thirteen hundred, or twelve hundred RPM, respectively.

Figures 2A, 2B, 2C:
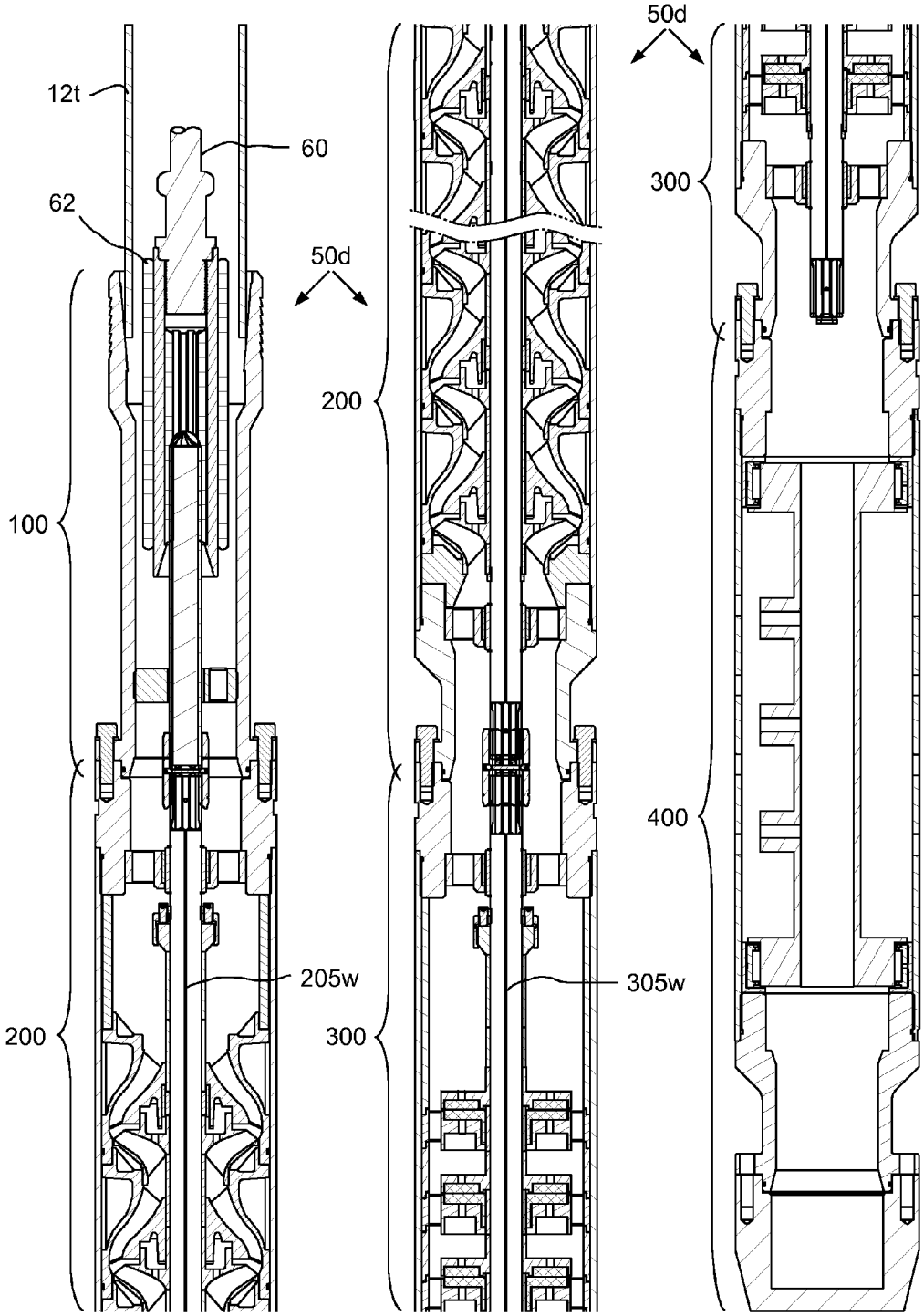
FIGS. 2A-C illustrate a downhole assembly of the ALS.
Figure 3A:
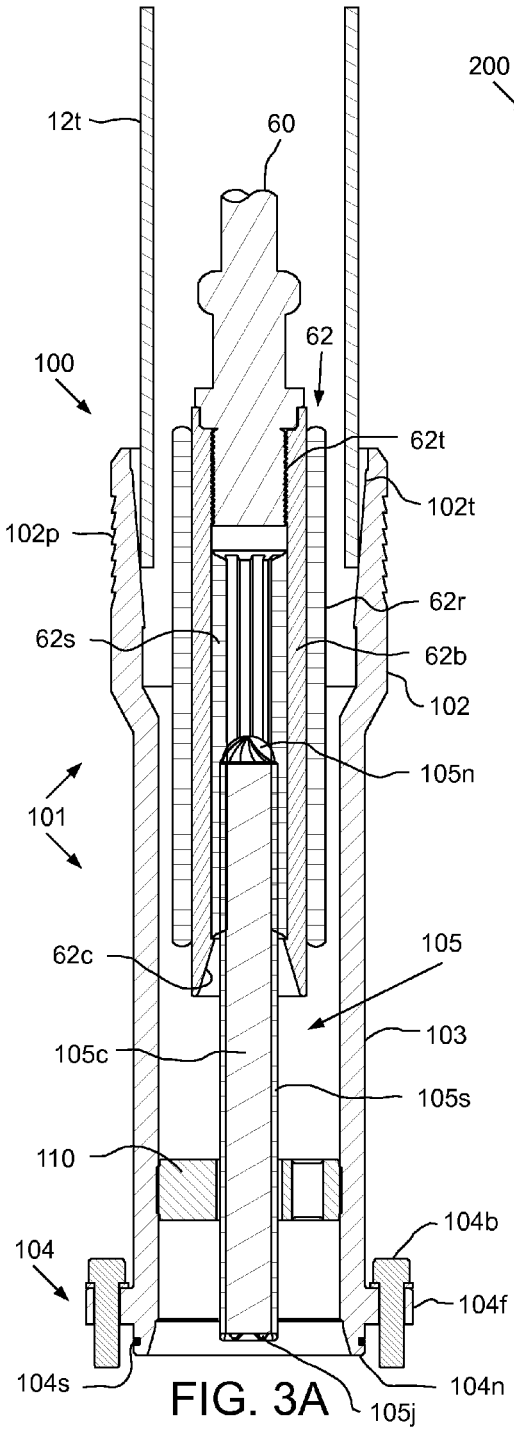
FIG. 3A illustrates a rod receptacle of the downhole assembly.

The polished rod 58 may be connected to the output shaft 53 by the clamp 54. The clamp 54 may torsionally and longitudinally connect the output shaft 53 and the polished rod 58 such that the polished rod is driven at the output speed 59*o* and the output shaft may transfer weight of the drive string 50*r* to the thrust bearing 57. The polished rod 58 may be longitudinally and torsionally connected to the drive string 50*r*, such as by a threaded connection (not shown), such that the drive string is also driven at the output speed 59*o*. The drive string 50*r* may extend from the production wellhead 2*p* and into the production wellbore 3*p*. The drive string 50*r* may include a continuous sucker rod 60, stabilizers 61 spaced therealong at regular intervals, and a rod coupling 62 (FIGS. 2A and 3A). Alternatively, the drive string may include a jointed sucker rod string (sucker rods and couplings), coiled tubing, or a drill pipe string instead of the continuous sucker rod.

FIGS. 2A-C illustrate the downhole assembly 50*d*. The downhole assembly 50*d* may include a rod receptacle 100, a pump 200, a thrust chamber 300, and an intake 400.

FIG. 3A illustrates the rod receptacle 100. The rod receptacle 100 may include a housing 101 and a shaft 105 disposed in the housing and rotatable relative thereto.

The rod coupling 62 may be longitudinally and torsionally connected to a bottom of the continuous sucker rod 60, such as by a threaded connection. The rod coupling 62 may include a tubular body 62*b*. Ribs 62*r* may be formed along an outer surface of the body 62*b* and spaced therearound. Flow passages may be formed between the ribs 62*r* to minimize flow obstruction by the ribs. The ribs 62*r* may facilitate alignment of the rod coupling 62 with the receptacle shaft 105 when landing the rod coupling into the rod receptacle 100. An upper portion of the coupling body 62*b* may have a threaded inner surface 62*t* for connection to the continuous sucker rod 60. Splines 62*s* may be formed along and spaced around an inner surface of a mid and lower portion of the body 62*b*. A shoulder may be formed at an upper end of the body 62*b* for receiving the continuous sucker rod 60.

A conical landing guide 62*c* may be formed at a lower end of the body 62*b* to also facilitate alignment of the rod coupling 62 with the receptacle shaft 105 when landing the rod coupling into the rod receptacle 100. A clearance formed between the ribs 62*r* and an inner surface of the receptacle housing 101 may be less than or equal to a clearance formed between the receptacle shaft 105 and a maximum diameter of the landing guide 62*c* to ensure that the receptacle shaft is received by the landing guide 62*c*. Engagement of the landing guide 62*c* with the receptacle shaft 105 may even lift the rod coupling 62 from a bottom of the production tubing 12*t*. The rod coupling 62 may further have one or more relief ports (not shown) formed through a wall thereof for exhausting debris during landing of the rod coupling into the receptacle 100.

The receptacle housing 101 may include an upper connector portion 102, a tubular mid portion 103, and a lower connector portion 104. The upper connector portion 102 may flare outwardly from the mid portion 103 and have a threaded inner surface 102*t* for connection to the bottom of the production tubing 12*t*. An outer surface of the production tubing bottom may also be threaded (not shown). The upper connector portion 102 may also have a fishing profile 102*p* formed in an outer surface thereof to facilitate retrieval of the downhole assembly 50*d* in case the downhole assembly becomes stuck in the production wellbore 3*p* and cannot be removed using the production tubing 12*t*. The lower connector portion 104 may have a flange 104*f* formed in an outer surface thereof and a nose 104*n* formed at a lower end thereof. The flange 104*f* may have holes formed therethrough for receiving threaded fasteners, such as bolts 104*b*. The nose 104*n* may have a groove formed in an outer surface thereof for carrying a seal, such as an o-ring 104*s*. A stopper 110 may be disposed in the mid portion 103 and longitudinally connected thereto, such as by a threaded connection. The stopper 110 may have a bore accommodating the shaft 105 and a flow passage formed therethrough for accommodating pumping of the bitumen 8*p*.

The receptacle shaft 105 may include a solid core portion 105*c*, splines 105*s* formed along and spaced around an outer surface of the core portion, a guide nose 105*n* formed at an upper end thereof, and a landing guide formed at a lower end thereof. The guide nose 105*n* may be convex and have a spiral profile formed therein. The landing guide may be a serration 105*j* formed in a lower end of each of the splines 105*s*. When landing the rod coupling 62 into the rod receptacle 100, the guide nose 105*n* may engage the rod coupling splines 62*s* and rotate the receptacle shaft 105 relative to the rod coupling to align the receptacle splines 105*s* with spline-ways of the rod coupling (and vice versa). Mating of the splines 62*s*, 105*s* may torsionally connect the rod coupling 62 and the receptacle shaft 105 while allowing relative longitudinal movement therebetween. After mating of the receptacle and rod coupling splines 62*s*, 105*s*, lowering of the rod coupling 62 may continue until the lower end of the rod coupling body seats on the stopper 110. The lowering may be accommodated by the extended splines 62*s* of the rod coupling 62. Once seated, the rod coupling 62 may be raised into the operational position shown and the continuous sucker rod 60 clamped 54, thereby ensuring that the downhole assembly 50*d* does not bear the weight of the continuous sucker rod. The receptacle shaft 105 may further include shaft retainers (not shown) for longitudinally restraining the shaft within the receptacle housing 101 during assembly and deployment of the downhole assembly 50*d*. The shaft retainers may engage the stopper 110 while allowing limited relative longitudinal movement of the shaft 105 relative to the housing 101 to accommodate operation of the receptacle shaft.

Figure 3B:
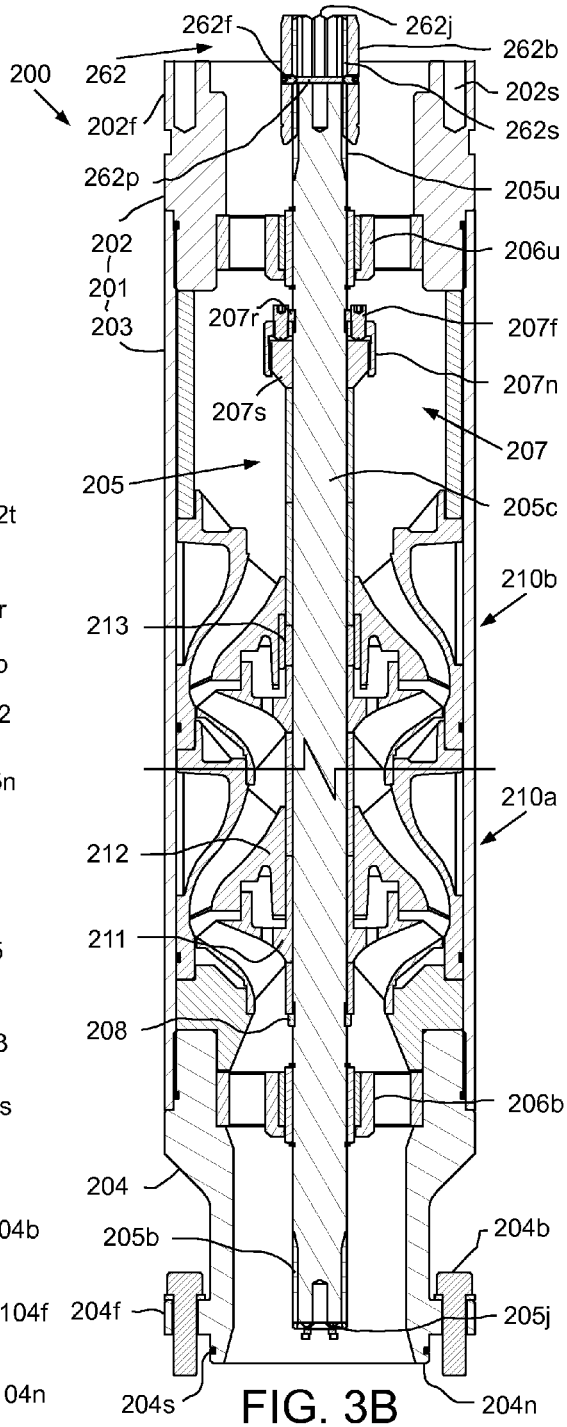
FIG. 3B illustrates a pump of the downhole assembly.

FIG. 3B illustrates the pump 200. The pump 200 may include a housing 201 and a shaft 205 disposed in the housing and rotatable relative thereto. To facilitate assembly, the pump housing 201 may include one or more sections 202-204, each section longitudinally and torsionally connected, such as by a threaded connection and sealed, such as by as an o-ring. Each housing section 202-204 may further be torsionally locked, such as by a tack weld (not shown). An upper connector section 202 may have a flange 202*f* formed at an upper end thereof and a seal face formed in an inner surface thereof. The flange 202*f* may have threaded sockets 202*s* formed therein for receiving shafts of the receptacle bolts 104*b*, thereby fastening the flanges 104*f*, 202*f* together and forming a longitudinal and torsional flanged connection between the receptacle housing 101 and the pump housing 201. The seal face may receive the receptacle nose 104*n* and seal 104*s*, thereby sealing the flanged connection. A lower connector portion 204 may have a flange 204*f*, a nose 204*n*, o-ring 204*s*, and bolts 204*b* similar to those discussed above for the receptacle 100.

The pump 200 may further include a shaft coupling 262 for longitudinally and torsionally connecting the receptacle shaft 105 and the pump shaft 205. The shaft coupling 262 may include a tubular body 262*b*. Splines 262*s* may be formed along and spaced around an inner surface of body 262*b*. A guide profile, such as a serration 262*j*, may be formed in an upper end of each of the splines 262*s* and may correspond to the receptacle shaft serration 105*j*. A support, such as a pin 262*p*, may extend across a bore of the body 262*b*. The pin 262*p* may be longitudinally connected to the body 262*b*, such as by fasteners 262*f*. The body 262*b* may have threaded holes formed through a wall thereof for receiving the fasteners 262*f* and the pin 262*p* may have a groove formed therein for receiving tips of the fasteners, thereby longitudinally connecting the pin and the body.

When assembling the downhole assembly 50*d* for deployment into the production wellbore 3*p*, the receptacle 100 may be lowered onto the pump 200. As the receptacle 100 is lowered onto the pump 200, the receptacle serrations 105*j* may engage the shaft coupling serrations 262*j*. Engagement of the serrations 105*j*, 262*j* may rotate the receptacle shaft 105 relative to the shaft coupling 262 to align the receptacle splines 105*s* with spline-ways of the shaft coupling (and vice versa). Mating of the splines may torsionally connect the shaft coupling 262 and the receptacle shaft 105 while allowing relative longitudinal movement therebetween. After mating of the receptacle and shaft coupling splines 105*s*, 262*s*, lowering of the receptacle 100 may continue until a lower end of the receptacle shaft 105 seats on the shaft coupling pin 262*p*, thereby longitudinally supporting the receptacle shaft 105 from the shaft coupling 262. After seating of the receptacle shaft 105, lowering of the receptacle 100 may continue until the receptacle flange 104*f* is adjacent the upper pump flange 202*f*. The flanges 104*f*, 202*f* may be manually aligned, seated, and fastened.

The pump shaft 205 may include a solid core portion 205*c*, upper 205*u* and lower 205*b* splines formed at and spaced around respective ends of the core portion, a keyway 205*w* (FIGS. 2A and 2B) formed along the core portion, and a landing guide formed at a lower end thereof. The landing guide may be a serration 205*j* formed in a lower end of each of the splines 205*s*. The shaft coupling 262 may be manually installed on the pump shaft upper end, thereby engaging the upper splines 205*u* with the coupling splines 262*s* and seating the coupling pin 262*p* on the shaft upper end. The installation may longitudinally and torsionally connect the pump shaft 205 to the shaft coupling 262.

The pump shaft 205 may be supported for rotation relative to the housing by radial bearings 206*u, b*. Each radial bearing 206*u, b* may include a body, an inner sleeve, and an outer sleeve. The sleeves may be made from a wear-resistant material, such as a tool steel, ceramic, or ceramic-metal composite (aka cermet). Each inner sleeve may be longitudinally connected to the pump shaft 205, such as by retainers (i.e., snap rings) engaged with respective grooves formed in an outer surface of the shaft core 205*c*, and torsionally connected to the shaft, such as by a press fit or key. Each outer sleeve may be longitudinally and torsionally connected to the bearing body, such as by a press fit. Each bearing body may be longitudinally and torsionally coupled to the respective housing sections 202, 204, such as by a press fit. Each bearing body may have flow passages formed therethrough for accommodating pumping of the bitumen 8*p* and the bearings may utilize the pumped bitumen for lubrication.

The pump 200 may be centrifugal, such as a radial flow or mixed axial/radial flow centrifugal pump. The pump 200 may include one or more stages 210*a, b* (six stages shown in FIGS. 2A and 2B). Each stage 210*a, b* may include an impeller 211 a diffuser 212, and an impeller spacer. Each even stage 210*b* may include a radial bearing 213 having an inner sleeve torsionally connected to the pump shaft, such as by a key (not shown) and keyway 205*w*, and an outer sleeve longitudinally and torsionally connected to the respective diffuser, such as by a press fit. The bearing sleeves 213 may be made from the wear resistant material, discussed above for the radial bearings 206*u, b*. Alternatively, each odd stage may include the bearing instead of the even stage or each stage may include the bearing. Each impeller 211 and impeller spacer may be torsionally connected to the pump shaft 205, such as by a key (not shown) and keyway 205*w*. The impellers 211 and impeller spacers may be longitudinally connected to the pump shaft 205 by compression between a compression fitting 207 and a retainer, such as a snap ring 208.

The compression fitting 207 may include a sleeve 207*s*, a nut 207*n*, a retainer, such as a snap ring 207*r*, and fasteners, such as set screws 207*f*. The snap ring 207*r* may be received in a groove formed in an outer surface of the shaft core 205*c* after the rest of the fitting has been disposed on the shaft core. The snap ring 208 may be installed on the shaft core 205*c* before the impellers 211 and may have a shoulder for receiving an impeller spacer. The snap ring 207*r* may have a shoulder for receiving the nut 207*n*. The sleeve 207*s* may be torsionally connected to the shaft 205, such as by a key (not shown) and keyway 205*w*. The sleeve 207*s* may have a threaded outer surface for receiving a threaded inner surface of the nut 207*n*. Rotation of the nut 207*n* relative to the sleeve 207*s* may longitudinally drive the sleeve into engagement with an impeller spacer, thereby compressing the impellers, impeller bearings, and impeller spacers. Once tightened to a predetermined torque, the nut 207*n* may be torsionally connected to the compression sleeve 207*s* by installing or tightening the set screws 207*f*. Rotation of the nut 207*n* relative to the sleeve 207*s* may longitudinally drive the sleeve into engagement with an impeller spacer, thereby compressing the impellers, impeller bearings, and impeller spacers. Once tightened to a predetermined torque, the nut 207*n* may be torsionally connected to the compression sleeve 207*s* by installing or tightening the set screws 207*f*.

The diffusers 212 may be longitudinally and torsionally connected to the pump housing 201, such as by compression between the upper 202 and lower 204 connector sections (and diffuser spacers). Rotation of each impeller 211 by the pump shaft 205 may impart velocity to the bitumen 8*p* and flow through the stationary diffuser 212 may convert a portion of the velocity into pressure. The pump 200 may deliver the pressurized bitumen 8*p* to the production tubing 12*t* via the receptacle 100.

Figure 4A:
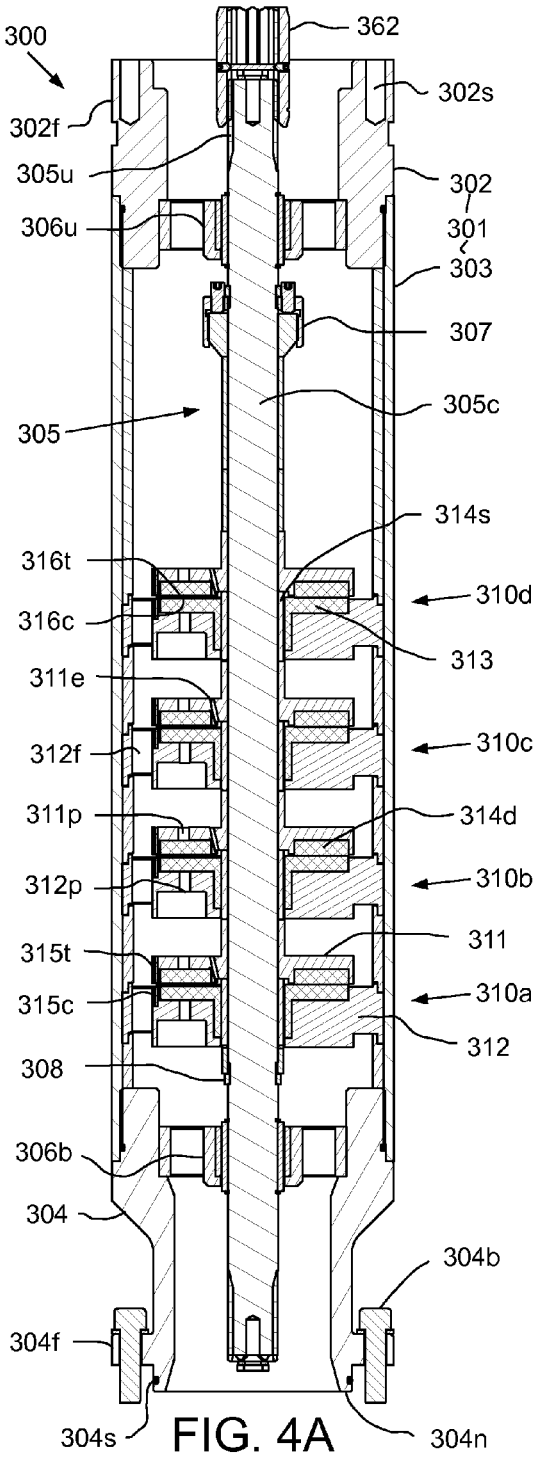
FIG. 4A illustrates a thrust chamber of the downhole assembly.

FIG. 4A illustrates the thrust chamber 300. The thrust chamber 300 may include a housing 301 and a shaft 305 disposed in the housing and rotatable relative thereto. To facilitate assembly, the chamber housing 301 may include one or more sections 302-304, each section longitudinally and torsionally connected, such as by a threaded connection and sealed, such as by as an o-ring. Each housing section 302-304 may further be torsionally locked, such as by a tack weld (not shown). An upper connector section 302 may have a flange 302*f* formed at an upper end thereof and a seal face formed in an inner surface thereof. The flange 302*f* may have threaded sockets 302*s* formed therein for receiving shafts of the lower pump flange bolts 204*b*, thereby fastening the flanges 204*f*, 302*f* together and forming a longitudinal and torsional flanged connection between the pump housing 201 and the chamber housing 301. The seal face may receive the lower pump flange nose 204*n* and seal 204*s*, thereby sealing the flanged connection. A lower connector portion 304 may have a flange 304*f*, a nose 304*n*, o-ring 304*s*, and bolts 304*b* similar to those discussed above for the receptacle 100.

The thrust chamber 300 may further include a shaft coupling 362 for longitudinally and torsionally connecting the pump shaft 205 and the chamber shaft 305. The chamber shaft coupling 362 may be similar to the pump shaft coupling 262, discussed above and assembly of the pump 200 onto the thrust chamber 300 may be similar to assembly of the receptacle 100 onto the pump 200, discussed above. The chamber shaft 305 may include a solid core portion 305*c*, upper 305*u* and lower splines formed at and spaced around respective ends of the core portion, a keyway 305*w* (FIGS. 2B and 2C) formed along the core portion, and a landing guide formed at a lower end thereof. Alternatively, the lower splines and/or the lower landing guide may be omitted. The chamber shaft 305 may be supported for rotation relative to the chamber housing by radial bearings 306*u, b*, similar to the pump radial bearings 206*u, b*, discussed above.

The thrust chamber 300 may further include one or more thrust bearings 310*a-d*. Each thrust bearing 310*a-d* may include a thrust driver 311, a thrust carrier 312, a radial bearing 314*s*, a runner thrust disk 314*d*, and a carrier pad 313. The thrust bearings 310*a-d* may receive both impeller thrust and pressure thrust from the rotating pump shaft 205 via the shaft coupling 362 and be capable of transferring the thrusts to the stationary production tubing 12*t* via housings 101-301.

Each thrust driver 311, radial bearing 314*s*, and runner spacer may be torsionally connected to the chamber shaft 305, such as by a key (not shown) and keyway 305*w*. The thrust drivers 311, radial bearings 314*s*, and runner spacers may be longitudinally connected to the chamber shaft 305 by compression between a compression fitting 307 and a retainer, such as a snap ring 308. The compression fitting 307 may be similar to the pump compression fitting 207, discussed above. Each thrust disk 314*d* may be received in a recess formed in the respective thrust driver 311. Each thrust disk 314*d* may be longitudinally connected to the thrust driver 311, such as by a press fit. Each thrust disk 314*d* may be torsionally connected to the thrust driver 311, such as by a fastener (i.e., a pin 315*t*). Each pin 315*t* may be received by a hole formed through the respective thrust driver 311 at a periphery thereof and extend into an opening formed through the respective thrust disk 314*d* at a periphery thereof. The pin 315*t* may be press fit into the thrust driver hole. The thrust disks 314*d*, carrier pads 313, and radial bearings 314*s* may each be made from the wear resistant material, discussed above for the radial bearings 206*u, b*.

Each thrust disk 314*d* may have lubricating grooves 316*t* formed in a bearing face thereof. The lubricating grooves 316*t* may be radial, tangential, angled, or spiral and may extend partially or entirely across the bearing face. Each thrust driver 311 may have a lubrication passage 311*p* formed therethrough in fluid communication with the recess. Each thrust driver 311 may further have a debris passage 311*e* formed therethrough for exhausting debris from a thrust interface between the thrust disk 314*d* and a thrust portion of the carrier pad 313. Each radial bearing 314*s* may be a sleeve and operable to radially support rotation of the thrust drivers 311 relative to the thrust carriers 312 by engagement with a radial portion of the respective carrier pad 313.

The carriers 312 may be longitudinally and torsionally connected to the chamber housing 301, such as by compression between the upper 302 and lower 304 connector sections (and spacers). Each carrier pad 313 may be received in a recess formed in the respective carrier 312. Each carrier pad 313 may be longitudinally connected to the carrier 312, such as by a press fit. Each carrier pad 313 may be torsionally connected to the carrier, such as by a fastener (i.e., a pin 315*c*). Each pin 315*c* may be received by a hole formed through the respective carrier 312 at a periphery thereof and extend into an opening formed through the respective carrier at a periphery thereof. The pin 315*c* may be press fit into the carrier hole. Each carrier pad 313 may have a thrust portion and a radial portion, each portion perpendicular to the other, thereby forming a T-shaped cross section. Alternatively, a separate carrier disk and a carrier sleeve may be used instead of the T-shaped carrier pad. A thrust portion of each carrier pad 313 may have lubricating grooves 316*c* formed in a bearing face thereof, similar to the runner disk grooves 316*t*, discussed above. Each carrier may have a lubrication passage 312*p* formed therethrough in fluid communication with the recess. Each carrier 312 may also have a flow passage 312*f* formed therethrough for accommodating pumping of the bitumen 8*p* and the thrust bearings 310*a-d* may utilize the pumped bitumen for lubrication via passages 311*p*, 312*p*.

Figure 4B:
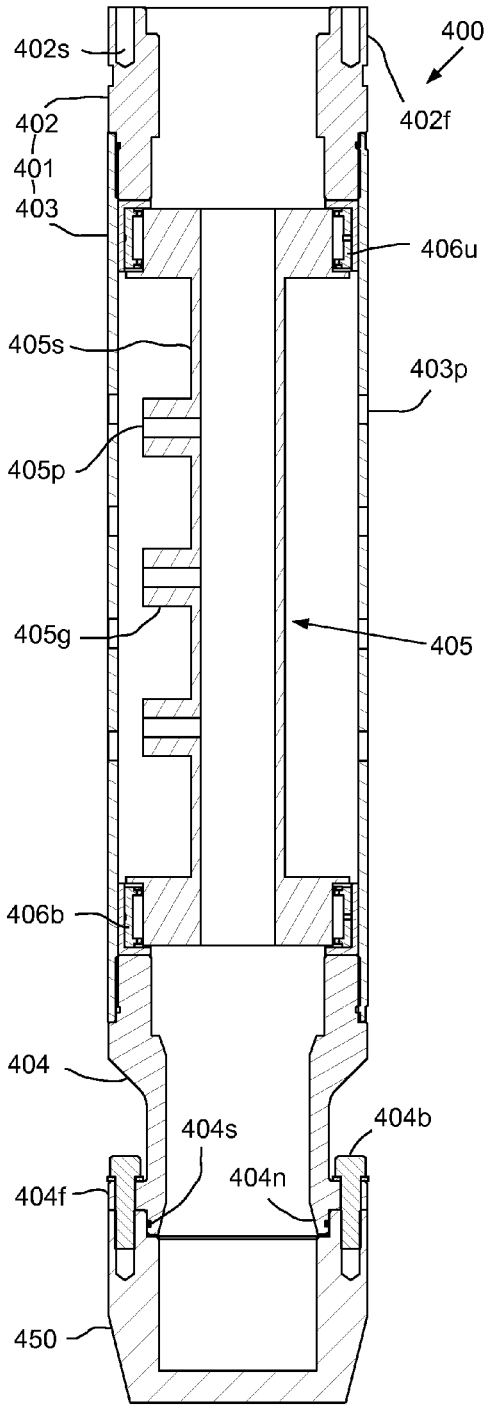
FIG. 4B illustrates an intake of the downhole assembly.
Figures 5A, 5B, 5C, 5D:
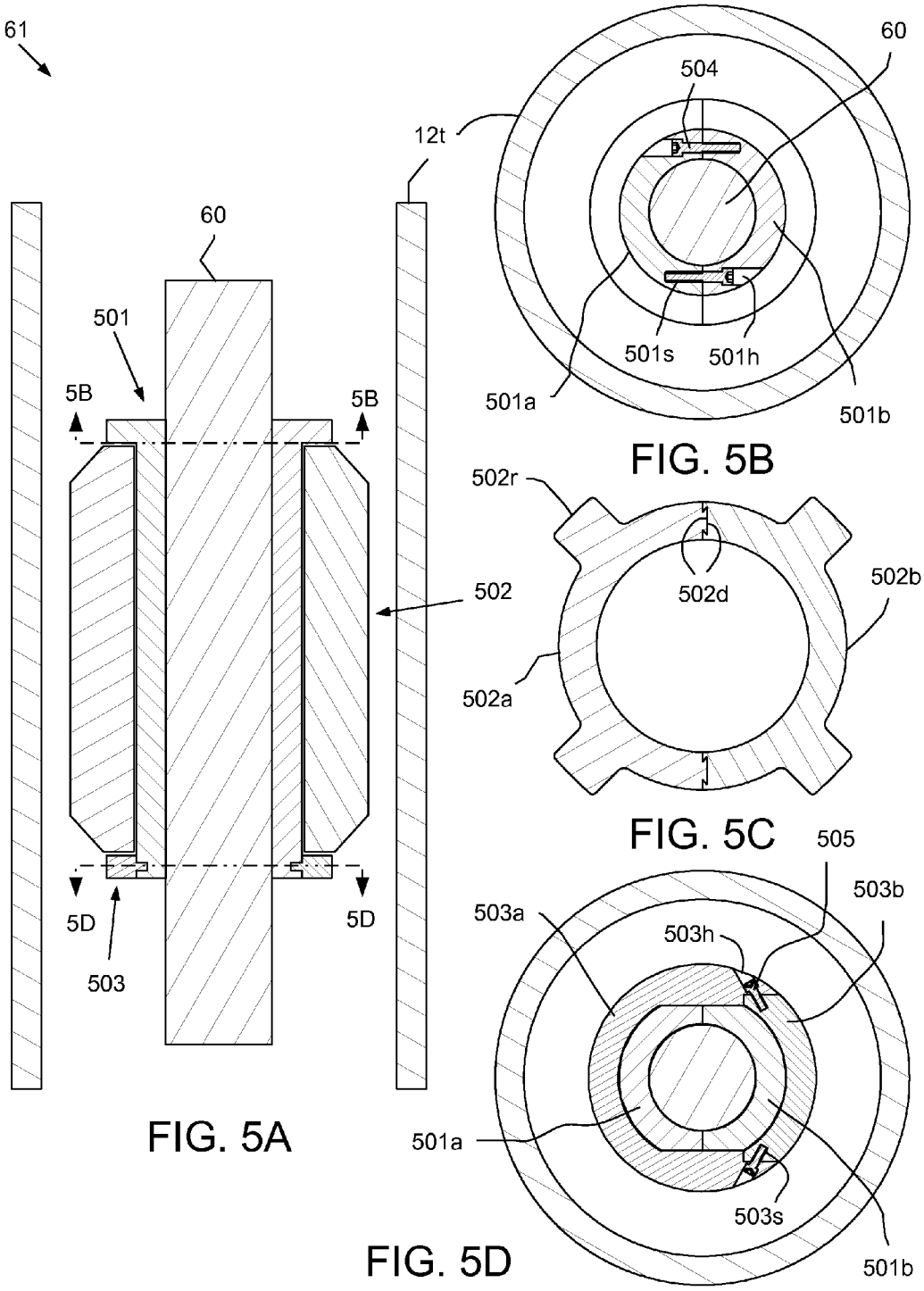
FIGS. 5A-5D illustrate a stabilizer of the ALS.

FIG. 4B illustrates the intake 400. The intake 400 may include a housing 401 and a flow tube 405 disposed in the housing and rotatable relative thereto. To facilitate assembly, the intake housing 401 may include one or more sections 402-404, each section longitudinally and torsionally connected, such as by a threaded connection and sealed, such as by as an o-ring. Each housing section 402-404 may further be torsionally locked, such as by a tack weld (not shown). An upper connector section 402 may have a flange 402*f* formed at an upper end thereof and a seal face formed in an inner surface thereof. The flange 402*f* may have threaded sockets 402*s* formed therein for receiving shafts of the lower chamber flange bolts 304*b*, thereby fastening the flanges 304*f*, 402*f* together and forming a longitudinal and torsional flanged connection between the chamber housing 301 and the intake housing 401. The seal face may receive the lower chamber flange nose 304*n* and seal 304*s*, thereby sealing the flanged connection. A lower connector portion 404 may have a flange 404*f*, a nose 404*n*, o-ring 404*s*, and bolts 404*b* similar to those discussed above for the receptacle 100.

A mid housing section 403 may have one or ports 403*p* formed through a wall thereof for receiving the bitumen 8*p* from the production wellbore 3*p*. The ports 403*p* may be formed along and spaced around the mid housing section 403. The flow tube 405 may one or more ports 405*p* formed through a wall thereof. The flow tube may also have one or more weights 405*g* formed in an outer surface thereof or disposed thereon, such as by a weld. The weights 405*g* may be located adjacent each port 405*p*. Each weight 405*j* may include a pair of bands and fasteners (not shown) for assembly of the weight adjacent each port 405*p*. Each tube port 405*p* may also extend to a location adjacent the housing ports 403*p*. The flow tube 405 may be supported for rotation relative to the housing 401 by one or more radial bearings 406*u, b*. Each radial bearing 406*u, b* may be rolling element bearing, such as a needle bearing. When the downhole assembly

50*d* is deployed in the horizontal portion of the production wellbore 3*p*, the weights 405*g* may create eccentricity in the flow tube 405, thereby causing the flow tube to rotate relative to the housing 401 such that the flow tube ports 405*p* face downwardly in the production wellbore 3*p*. This may utilize a natural separation effect in the production wellbore 3*p* such that the flow tube ports 405*p* intake the bitumen 8*p* rather than steam vapor or other gas.

The downhole assembly 50*d* may further include a guide shoe 450. The guide shoe 450 may have a flange formed at an upper end thereof and a seal face formed in an inner surface thereof. The flange may have threaded sockets formed therein for receiving shafts of the lower intake flange bolts 404*b*, thereby fastening the flanges together and forming a longitudinal and torsional flanged connection between the intake housing 401 and the guide shoe 450. The seal face may receive the lower intake flange nose 404*n* and seal 404*s*, thereby sealing the flanged connection.

FIGS. 5A-5D illustrate the stabilizer 61. The stabilizer 61 may include a collar 501, a sleeve 502, and a clamp 503. The collar 501 may be rotatable relative to the sleeve 502. The sleeve 502 may be operable to engage an inner surface of the production tubing 12*t* and radially support rotation of the collar 501 therefrom. The collar 501 may include a pair of bands 501*a, b*. Each band 501*a, b* may be semi-tubular and include a hole 501*h* formed tangentially through a wall thereof and a threaded socket 501*s* tangentially formed in the wall. Each hole 501*h* and mating socket 501*s* may receive a threaded fastener 504, thereby longitudinally and torsionally connecting the collar bands 501*a, b* together. Connection of the collar bands 501*a, b* around the continuous sucker rod 60 may longitudinally and torsionally connect the collar 501 to the rod 60 by compressing an inner surface of the bands 501*a, b* against the rod 60.

The sleeve 502 may include a pair of bands 502*a, b*. Each band 502*a, b* may be semi-tubular and have connector profiles, such as dovetails 502*d*, formed therealong. Engagement of the dovetails 502*d* may torsionally connect the sleeve bands 502*a, b* together. The sleeve bands 502*a, b* may be longitudinally connected by entrapment between a shoulder formed at an upper end of the collar 501 and the clamp 503. The entrapment may also longitudinally connect the sleeve 502 and the collar 501. The sleeve 502 may further have ribs 502*r* formed along and spaced around an outer surface thereof. The ribs 502*r* may engage an inner surface of the production tubing 12*t* while minimizing obstruction to pumping of the bitumen 8*p* through the production tubing.

The clamp 503 may include a pair of bands, such as a major band 503*a* and a minor band 503*b*. Each band 503*a, b* may be arcuate and the major band 503*a* may include a pair of holes 503*h* formed through a wall thereof. Correspondingly, the minor band may include pair of threaded sockets 503*s* formed in a wall thereof. Each hole 503*h* and mating socket 503*s* may receive a threaded fastener 505, thereby longitudinally and torsionally connecting the bands 503*a, b* together. The collar 501 may have a pair of flats formed in an outer surface thereof and located at a lower end thereof. The major band 503*a* may have a pair of bosses formed in an inner surface thereof for engaging the flats. Connection of the clamp bands 503*a, b* around the collar 501 may longitudinally and torsionally connect the clamp 503 to the collar by engagement of the bosses with the flats.

The collar 501 and clamp 503 may be made from a metal or alloy, such as steel, stainless steel, or a nickel based alloy. The sleeve 502 may be made from a high-temperature and wear-resistant polymer, such as a cross-linked thermoplastic, a thermoset, or a copolymer.

While the foregoing is directed to embodiments of the present invention, other and further embodiments of the invention may be devised without departing from the basic scope thereof, and the scope thereof is determined by the claims that follow.

The invention claimed is:

1. A method of pumping production fluid from a wellbore, comprising:

deploying a centrifugal pump into a production wellbore; and pumping hydrocarbons from the production wellbore by rotating an impeller of the centrifugal pump in the production wellbore from surface using a drive string, wherein:

the impeller is rotated at a speed less than or equal to seventeen hundred fifty revolutions per minute, and the centrifugal pump comprises a thrust bearing receiving thrust from a shaft of the centrifugal pump and being lubricated by the pumped hydrocarbons.

2. The method of claim 1, further comprising injecting steam into an injection wellbore traversing a hydrocarbon bearing formation, wherein the production wellbore receives heated hydrocarbon drainage from the formation.

3. The method of claim 1, wherein a thrust disk and carrier pad of the thrust bearing are made from tool steel, ceramic, or cermet.

4. The method of claim 1, wherein:

the hydrocarbons are pumped to the surface through production tubing, and the drive string is directly supported from the production tubing by stabilizers spaced along the drive string.

5. The method of claim 4, wherein each stabilizer comprises:

a sleeve engaged with an inner surface of the production tubing, and a collar longitudinally and torsionally coupled to the drive string and rotating relative to the sleeve.

6. The method of claim 5, wherein each of the collar and the sleeve comprise a pair of bands.

7. The method of claim 5, wherein:

the sleeve has ribs formed along and spaced around an outer surface thereof, and one or more of the ribs are engaged with the production tubing inner surface.

8. The method of claim 5, wherein the collar is made from a metal or alloy and the sleeve is made from a polymer.

9. A downhole assembly of an artificial lift system, comprising:

a receptacle for receiving a coupling of a drive string, the receptacle comprising a housing having a coupling for connection to a production tubing string and a shaft;

a centrifugal pump comprising a housing connected to the receptacle housing and a shaft connected to the receptacle shaft; and a thrust chamber comprising:

a housing connected to the pump housing, a shaft torsionally and longitudinally connected to the pump shaft, and a thrust bearing having a thrust driver longitudinally and torsionally connected to the chamber shaft and a thrust carrier longitudinally and torsionally connected to the chamber housing, wherein:

the thrust bearing is operable to receive thrust from the pump shaft, and the thrust bearing is in fluid communication with a pumped fluid path.

10. The downhole assembly of claim 9, wherein the thrust bearing further has a thrust disk torsionally connected to the thrust driver and a carrier pad torsionally connected to the thrust carrier.

11. The downhole assembly of claim 10, wherein:

the thrust disk has lubricating grooves formed in a bearing face thereof, and the thrust driver has:

a lubrication passage formed therethrough, and a debris passage formed therethrough.

12. The downhole assembly of claim 10, wherein:

the carrier pad has lubricating grooves formed in a bearing face thereof, and the thrust carrier has:

a lubrication passage formed therethrough, and a flow passage formed therethrough.

13. The downhole assembly of claim 10, wherein the thrust disk and carrier pad are made from tool steel, ceramic, or cermet.

14. The downhole assembly of claim 10, wherein:

the carrier pad has a thrust portion and a radial portion, and the thrust bearing further has a radial bearing sleeve torsionally connected to the thrust chamber shaft.

15. The downhole assembly of claim 9, further comprising an intake comprising:

a housing connected to the thrust chamber housing and having one or more ports formed through a wall thereof, and a flow tube: disposed in the housing, rotatable relative thereto, and having one or more ports formed through a wall thereof and one or more weights located adjacent each port.

16. The downhole assembly of claim 10, wherein the thrust disk is received in a recess formed in the thrust driver and the carrier pad is received in a recess formed in the thrust carrier.

17. The downhole assembly of claim 10, wherein the thrust bearing further has:

an inner radial bearing sleeve torsionally connected to the thrust chamber shaft, and an outer radial bearing sleeve torsionally connected to the thrust carrier.

18. The downhole assembly of claim 9, wherein the centrifugal pump further comprises:

a diffuser connected to the pump housing, and an impeller connected to the pump shaft.

19. The downhole assembly of claim 9, further comprising an intake, wherein the thrust chamber is disposed between the centrifugal pump and the intake.

20. The downhole assembly of claim 9, wherein the thrust bearing is in fluid communication with the pumped fluid path for lubrication thereof.

21. The downhole assembly of claim 9, wherein:

the receptacle shaft has having a torsional profile for being driven by the drive string, and the pump shaft is torsionally connected to the receptacle shaft.

22. An artificial lift system (ALS), comprising:

the downhole assembly of claim 21; and the drive coupling comprising a housing having:

a coupling formed at an upper end thereof for connection to the drive string, a torsional profile formed in an inner surface thereof for mating with the receptacle shaft torsional profile, and a landing guide formed in a lower end thereof.

23. The ALS of claim 22, further comprising a drive head, comprising:

a polished rod for connection to an upper end of the drive string, a motor for rotating the polished rod at an output speed less than or equal to 1,750 revolutions per minute, and a thrust bearing for supporting the polished rod.

24. The ALS of claim 23, further comprising the drive string for rotating the downhole assembly at the output speed, wherein the drive string is continuous sucker rod.

25. The ALS of claim 23, further comprising a steam generator for heating a hydrocarbon bearing formation, wherein the downhole assembly is operable to pump drainage from the formation to surface.

* * * * *